US006024810A

United States Patent [19]

Neidert et al.

[11] Patent Number: 6,024,810

[45] Date of Patent: Feb. 15, 2000

[54] CASTABLE DOUBLE BASE SOLID ROCKET PROPELLANT CONTAINING BALLISTIC MODIFIER PASTED IN AN INERT POLYMER

[75] Inventors: Jamie B. Neidert, Jeffersonton; Edna M. Williams, Chester Gap, both of Va.

[73] Assignee: Atlantic Research Corporation, Gainesville, Va.

[21] Appl. No.: 09/166,942

[22] Filed: Oct. 6, 1998

[51] Int. Cl.[7] ..... C06B 45/10; C06B 25/18; C06B 25/20

[52] U.S. Cl. ..... 149/19.8; 149/19.4; 149/19.5; 149/19.6; 149/96; 149/98; 149/100

[58] Field of Search ..... 149/19.4, 19.91, 149/96, 98, 19.8, 19.5, 19.6, 100

[56] References Cited

U.S. PATENT DOCUMENTS

| | | | |
|---|---|---|---|
| H934 | 7/1991 | Ducote | 149/19.4 |
| 3,580,753 | 5/1971 | Griffith | 149/39 |
| 3,711,344 | 1/1973 | Pierce | 149/19 |
| 3,856,590 | 12/1974 | Kincaid et al. | 149/19.8 |
| 3,956,890 | 5/1976 | Davis | 149/19 |
| 4,014,720 | 3/1977 | Wells | 149/19.8 |
| 4,051,207 | 9/1977 | Brachert et al. | 264/3 |
| 4,080,411 | 3/1978 | Stanley | 264/3 |
| 4,214,929 | 7/1980 | Camp et al. | 149/109.4 |
| 4,234,364 | 11/1980 | Robinson, Jr. | 149/19.4 |
| 4,243,442 | 1/1981 | Armantrout | 149/19.92 |
| 4,285,734 | 8/1981 | Marzocchi et al. | 106/273 |
| 4,298,411 | 11/1981 | Godsey | 149/19.4 |
| 4,381,958 | 5/1983 | Howard | 149/19.8 |
| 4,386,978 | 6/1983 | Baczuk et al. | 149/19.4 |
| 4,420,350 | 12/1983 | Camp et al. | 149/98 |
| 4,477,297 | 10/1984 | Chi | 149/109.6 |
| 4,659,402 | 4/1987 | Comfort | 149/19.4 |
| 5,192,379 | 3/1993 | Johnson et al. | 149/19.4 |
| 5,372,664 | 12/1994 | Neidert et al. | 149/19.8 |
| 5,385,619 | 1/1995 | Downes et al. | 149/19.4 |
| 5,468,311 | 11/1995 | Godsey et al. | 149/19.4 |
| 5,468,313 | 11/1995 | Wallace, II et al. | 149/53 |

*Primary Examiner*—Charles T. Jordan
*Assistant Examiner*—Aileen J. Baker
*Attorney, Agent, or Firm*—Nixon & Vanderhye P.C.

[57] ABSTRACT

Castable propellant formulations are provided including reduced toxicity ballistic modifiers that do not adversely increase the sensitivity of the propellant to shock detonation. Failure to adequately control the propellant burn rate often results in unacceptable performance of the propellant. Carbon can act as an effective ballistic, but not to the extent of metal compounds. It has been found that pasting a ballistic modifier, including ballistic modifiers containing lead, in an inert polymer modifies the burn rate of propellants while allowing the use of a reduced amount of modifier to achieve the same desired burn rate modification as the prior art, and therefore creating reduced shortcomings associated with the ballistic modifiers. Accordingly, the use of from about 1% to about 6% burn rate modifier wherein the burn rate modifier includes a ballistic modifier pasted in an inert polymer is taught as an effective burn rate modifier in a propellant, in order to provide reduced toxicity means for modifying the propellant burn rate without increasing the sensitivity of the propellant to shock detonation.

9 Claims, 3 Drawing Sheets

CASTABLE DOUBLE BASE SOLID ROCKET PROPELLANT CONTAINING BALLISTIC MODIFIER PASTED IN AN INERT POLYMER

BACKGROUND OF THE INVENTION

1. Field of the Invention

The present invention is related to methods and compositions for safely modifying the burn rate of solid rocket propellants containing nitrocellulose (NC), without increasing the sensitivity of the propellant to shock detonation. More particularly, the present invention is related to a castable, double-base solid rocket propellant utilizing a ballistic modifier pasted in an inert polymer to modify the burn rate thereof.

2. Background Art

In the manufacture of solid rocket motors, a number of components are required. There must be an adequate rocket motor case. The rocket motor case is designed to form the exterior of the rocket motor and provides the essential structural integrity for the rocket motor. Conventionally, the rocket motor case is made from a rigid, yet durable, material such as steel or filament wound composite.

A solid rocket propellant is generally placed within the interior of the rocket motor case. The propellant forming the grain is conventionally burned within the interior of the rocket motor case. The formation of high pressure hot gases upon burning of the propellant, and the subsequent exit of those gases through the throat and nozzle of the case provide thrust to propel the rocket motor.

There are two major classes of propellants used in conventional applications. These include solid propellants and liquid propellants. Solid propellants have been developed as the preferred method of powering most missiles and rockets for military, commercial, and space applications. This disclosure specifically addresses solid rocket fuels.

A crucial consideration in solid propellants is providing a means for controlling the burn rate of the propellant. It is important that the propellant burn at a controlled and predictable rate without performance loss. Excessively high burning rate creates pressures within the casing that may exceed its design capability, resulting in damage or destruction to the device. Insufficient burn rate may not provide sufficient thrust to propel the rocket motor over the desired course. Accordingly, it is conventional in the art to add materials to the propellant to control the burn rate of the propellant. With control of the burn rate of the propellant, proper operation of the rocket motor or other similar device is possible.

Materials that control the burn rate are referred to as burn rate modifiers or ballistic modifiers. In order to achieve an acceptable burn rate, certain metals have been commonly added to the propellant as ballistic modifiers, but these metals have proven relatively toxic. For example, lead is the most widely used burn rate modifier for certain classes of solid propellants. Lead, however, is known to be a hazardous, toxic, and polluting metal. Concern with lead pollution in society as a whole is on the rise, and serious health problems are known to be associated with lead poisoning and lead pollution.

Carbon fibers have been used with acceptable effect to replace lead as a ballistic modifier, as in U.S. Pat. No. 5,372,664, to overcome the above-noted shortcomings of lead as a burn rate additive. However, the use of carbon fibers does not lower the burning rate enough for certain tactical applications.

Accordingly, it would be a significant advancement in the art to provide methods and compositions for modifying propellant burn rates that maintain a high level of insensitivity of the mixture to shock detonation, while minimizing the toxicity problems encountered with conventional burn rate modifiers. It would be a significant advancement in the art to provide propellant compositions of such properties that do not exhibit increased sensitivity, while still retaining high energy.

Generally, it is also necessary that the rocket motor perform with reduced or eliminated smoke output. As an example, in tactical rocket motors, the production of smoke may obscure the vision of pilots or drivers of a craft or vehicle firing the tactical rocket. In addition, the production of smoke makes tracking the source of the motor easier, which is a serious disadvantage during military operations. Therefore, it would be a significant advancement in the art to provide propellant compositions of such properties that do not exhibit increased sensitivity, while still retaining high energy, and performing with eliminated or reduced smoke output.

SUMMARY AND OBJECTS OF THE INVENTION

It is an object of the present invention to overcome the deficiencies of the prior art and provide a burn rate modifier that is based on minimal levels of lead or similar toxic materials, but will not adversely increase the sensitivity of the propellant to accidental ignition.

More particularly, it is an object of the present invention to provide a burn rate modifier that includes a ballistic modifier pasted in an inert polymer to control burn rate of a propellant composition that will not adversely increase the sensitivity of the propellant to accidental ignition.

The present invention is related to methods and compositions for modifying the burn rate of solid rocket motor propellants, without increasing the sensitivity of the propellant to shock detonation, while minimizing the addition of expensive, toxic, or polluting materials such as lead. More particularly, the present invention is related to the use of a ballistic modifier pasted in an inert polymer to modify the burn rate of a solid rocket motor propellant. The addition of carbon alone or with other ballistic modifiers has been effective in modifying the burn rate of certain propellants, but not to the extent of metal additives. Pasting a ballistic modifier in an inert polymer has been found by the present inventors to provide a more usable and controllable propellant product, giving the same beneficial burn rate modification while using reduced amounts of ballistic modifier. Because the inert polymer matrix enables the use of smaller amounts of ballistic modifier, if the ballistic modifier contains a hazardous or toxic material, less hazardous or toxic materials are present in the propellant. It is a primary object of the present invention to provide methods and compositions for modifying propellant burn rates that avoid problems encountered with conventional ballistic modifiers.

The present invention has been found particularly effective in safely controlling the burn rate of propellants that contain a combination of nitrocellulose/nitrate esters and ammonium nitrate, which are widely used as solid rocket motor propellants.

These and other objects and advantages of the invention will become apparent upon reading the following detailed description and appended claims, and upon reference to the accompanying drawings.

DETAILED DESCRIPTION OF THE PREFERRED EMBODIMENTS

Figure 1:
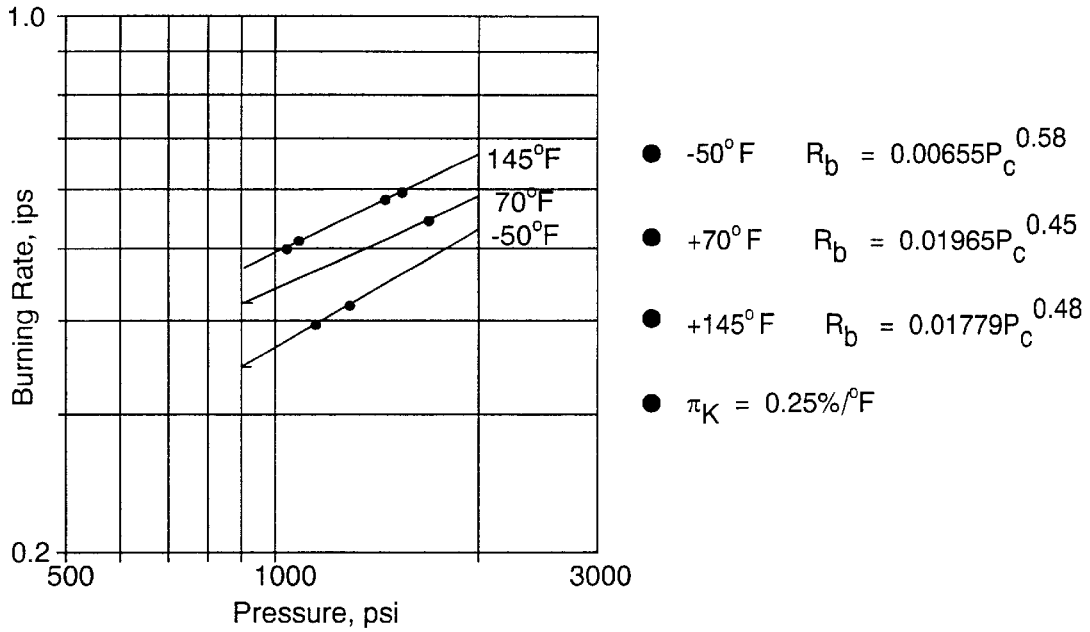
FIG. 1 is a graph plotting burn rate data obtained at three different temperatures for the propellant composition of the present invention.

The present invention is related to methods and compositions for modifying the burn rate of solid rocket motor propellants, while minimizing the addition of expensive, toxic, hazardous, or polluting materials, such as lead, copper, or related compounds, and without adversely increasing the sensitivity of the mixture. Specifically, the present invention is related to the use of a ballistic modifier pasted in an inert polymer to modify the burn rate of solid rocket motor propellants.

The present invention is particularly adaptable to propellants often referred to as "double base" propellants, which are propellants employing two base components; e.g., nitrocellulose (NC) and nitroglycerine (NG). Double base propellants have been widely used in the art.

A general rocket propellant may be formulated as follows:

| Material | Percentage Range |
|---|---|
| Ammonium Nitrate | 0–50 |
| Nitrocellulose | 12–40 |
| MNA | 1–2.5 |
| BTTN, MNA and/or DEGDN or TMETN or NG | 39–70 |
| RDX | 0–5 |

1,2,4 butanetriol trinitrate (BTTN), trimethylolethane trinitrate (TMETN), and diethylene glycol dinitrate (DEGDN) are utilized as plastizers in the propellant composition. Cyclotrimethylenetrinitramine (RDX) is utilized as a solid oxidizer. This type of propellant is also known to be relatively low in smoke output and, therefore, is desirable for uses where minimum smoke is a significant benefit. In addition, formulations within the ranges set forth above are found to be relatively insensitive to accidental ignition (32 cards in the NOL card gap test).

While such propellants will function nominally as rocket motor propellants, in the absence of ballistic modifiers, these propellant compositions are generally found to have high burn rates/pressure exponents that render them unusable. "Pressure exponent" refers to the slope of a logarithmic plot of burn rate versus pressure. In the absence of ballistic modifiers, the burn rate remains greater than 1.0 across a wide pressure range. It is generally found that a rocket motor propellant having a pressure exponent (n) where $n \geqq 1$ will not operate in a stable manner across a wide temperature range.

In order to achieve an acceptable burn rate, metals have been commonly added to the propellant as ballistic modifiers, but these metals have proven relatively toxic. For example, lead is the most widely used burn rate modifier for certain classes of solid propellants. Lead, however, is known to be a hazardous, toxic, and polluting metal. Concern with lead pollution in society as a whole is on the rise, and serious health problems are known to be associated with lead poisoning and lead pollution.

Carbon has been shown to be an effective ballistic modifier alone and in combination with other additives, since it can bring the pressure exponent of the resulting propellant composition below 1.0, thus providing stable operation over at least a range of operating conditions. Unfortunately, the addition of carbon is not as effective as lead compounds.

In order to deal with these problems, the present invention teaches the addition of a ballistic modifier pasted in an inert polymer to nitrate ester/nitrocellulose propellants to provide an improved burn rate modifier. It has been found that pasting the ballistic modifier in an inert polymer allows better dispersion of the ballistic modifier in the propellant. This superior dispersion permits the use of smaller amounts of ballistic modifier to achieve the desired burn rate modification. Specifically, it has been found that dispersing the ballistic modifier in this manner can effectively allow the reduction of modifier by almost 25% while maintaining all the advantages of the ballistic modifier. Additionally, the prepared formulations are considered explosive Class 1.3, which is much less sensitive than the current field of propellants. Such a propellant composition including the ballistic modifier of the present invention does not exhibit increased susceptibility to shock detonation, while also reducing toxicity hazard as compared to the prior art.

The ballistic modifiers contemplated by the present invention are bismuth, tin, and copper compounds and organometallic complexes, in addition to carbon. A preferred ballistic modifier is LC-12-15, which is a lead-copper complex of β-resorcylic acid and salicylic acid. The inventors have also noted that the above-noted combination works well with flake aluminum as a combustion stabilizer, since other types of aluminum yield Class 1.1 results and ineffective combustion stability.

The inert polymer can be any liquid polymer compatible with nitrate esters, including, but not limited to, polyester resin, polyethylene glycol (PEG), polyethylene glycol adipate (PGA), and polycaprolactone (PCP). The "pasted ballistic modifier" of the present invention is prepared by simply mixing the solid of interest, namely, the ballistic modifier, with the liquid polymer at a concentration that maximizes the ballistic modifier level while maintaining processability. The mixture is then passed through a roll mill up to three times, if necessary, to ensure complete homogeneity. Specifically, the pasted ballistic modifier includes approximately 40–70% by weight of the polymer in the paste. Preferably, the paste includes 50–65% ballistic modifier. Carbon may also be included in the paste in an amount equal to approximately 10–30% by weight of the total paste.

By providing the ballistic modifier in this "pasted" manner, the burn rate modifying characteristics of the ballistic modifier are enhanced by providing improved dispersion of the material. This permits the use of less ballistic modifier than in prior propellant compositions since 30–60% of the pasted ballistic modifier is actually the liquid polymer. This invention demonstrates the significant burning rate modification achieved in minimum smoke propellants with the use of a ballistic modifier pasted in an inert polymer. It is found that the addition of a ballistic modifier pasted in an inert polymer results in a controllable and usable burn rate over a significant range of operation, without increasing sensitivity of the mixture.

As described above, the present invention is particularly useful when used with propellant compositions based upon a combination of nitrocellulose/nitrate esters and ammonium nitrate. It should be appreciated, however, that the present invention will also be found beneficial with other types of propellants such as ammonium perchlorate-based, crosslinked double base (XLDB), minimum smoke (nitrato plasticized) propellants, as well as castable double base (CDB) formulations without ammonium nitrate.

The present invention generally has the following ingredients, in the following percentages (by weight):

| Material | Percentage Range (%) |
|---|---|
| Energetic Polymer | 8–35 |
| Energetic Oxidizer/Plasticizer | 60–90 |
| Burn Rate Modifier | 1–6 |
| Combustion Stabilizer | 0.5–1.5 |
| Curing Agent | 0.5–2.6 |
| Thermal Stabilizer | 1–2.5 |

It should be noted that the burn rate modifier noted above corresponds to a ballistic modifier pasted in an inert polymer.

A typical formulation falling within the scope of the present invention has the following ingredients, in the following percentages (by weight):

| Material | Percentage Range (%) |
|---|---|
| Nitrocellulose (NC) | 8–15 |
| BTTN/DEGDN | 60–80 |
| N-methylnitro aniline (MNA) | 1.5–2.5 |
| PNC | 5–20 |
| Carbon | 0.2–0.5 |
| LC-12-15 (pasted) | 2–5 |
| Flake aluminum | 0.0–1.0 |
| Desmodur N-3200 | 0.5–2.0 |
| 2-Nitrodiphenylamine (2-NDPA) | 0.5–1.5 |

The nitrocellulose (NC) and the plastisol nitrocellulose (PNC) function as energetic polymers, BTTN/DEGDN function as energetic oxidizers/plasticizers, N-methylnitro aniline (MNA) functions as a thermal stabilizer, the carbon and LC-12-15/polymer function as ballistic modifiers, the aluminum functions as a combustion stablizer and Desmodur N-3200 functions as a curing agent. Of course, the LC-12-15 ballastic modifier is pasted in an inert polymer, as provided above.

Propellants falling within the scope of the present invention are found to provide excellent bum rate control. In particular, formulations within the scope of the invention result in burning rate versus pressure curves that exhibit a bum rate exponent less than 1.0, and less than 0.60 at temperature ranges between −50° F. and 145° F. As mentioned above, a burn rate exponent of less than 1.0 will provide the ability to control the pressure produced by burning the propellant, and will allow the construction of a propellant grain that is suitable for use in a rocket motor casing.

In addition, the propellants are insensitive (≦50 cards in the NOL card gap test). This increases the safety of the propellants and provides the ability to use the propellants with confidence, even in hazardous environments such as military operations. Such insensitive propellants are much less likely to be accidentally initiated and limitations on shipping and storage are lessened.

Furthermore, it is found that the formulations of the present invention exhibit other beneficial characteristics. For example, the propellants of the present invention are generally low smoke. This is a significant benefit, especially when the propellant is to be used in a tactical rocket motor. Low smoke propellants make it more difficult to precisely locate the point from which the rocket motor was fired. In addition, low smoke characteristics ensure that visibility is not obstructed at the point of firing.

Specifically, the above noted typical formulation exhibits the following mechanical and performance parameters.

TABLE 1

| MECHANICAL PROPERTIES | |
|---|---|
| +165° F., E (psi)/$\sigma_m$(psi)/$\epsilon_m$(%) | 100/60/42 |
| +145° F., E (psi)/$\sigma_m$(psi)/$\epsilon_m$(%) | 230/70/30 |
| +70° F., E (psi)/$\sigma_m$(psi)/$\epsilon_m$(%) | 470/170/38 |
| −50° F., E (psi)/$\sigma_m$(psi)/$\epsilon_m$(%) | 18248/2502/27 |
| −65° F., E (psi)/$\sigma_m$(psi)/$\epsilon_m$(%) | 19500/3200/24 |
| PERFORMANCE PARAMETERS | |
| $I_{sp}$ ($lb_f$-sec/$lb_m$) | 243.2 |
| $R_b$ @ 1000 psi, (in/sec) | 0.48 |
| Pressure Exponent | 0.48 |
| NOL Card Gap (cards) | +45/−50 |

where E is modulus, $\sigma_m$ is the sheer stress, $\epsilon_m$ is the sheer strain, $I_{sp}$ is the theoretical impulse, and $R_b$ is the burn rate for the propellant composition.

FIG. 1 also provides a 2×4 motor burning rate data plot for the above-note formulation at −50° F., +70° F., and +145° F. As provided by this Figure, the burning rates and pressure exponents (which is the slope of the burning rate vs. pressure plot) over the range of −50 to +145° F. are acceptable for tactical motor applications. Although $\pi_k$ somewhat high, it is typical of unfilled doublebase propellants with nitrocellulose binder systems.

Hazard tests were also conducted on the formulation. Specifically, a 5"×10" configured propellant grain in a roll bonded case and one-inch web were utilized. Table 2 provides the results of these hazard tests.

TABLE 2

| HAZARD TESTS | | |
|---|---|---|
| Test Type | Test 1 Result | Test 2 Result |
| Multiple Bullet Impact | No reaction (3 bullets) | No reaction (1 bullet) |
| Slow Cookoff | | Burn @ 264° F. |
| Multiple Fragment Impact | Burn - 2 fragments | Burn - 4 fragments |
| NOL Card Gap | +45/−50 | |

Figure 2:
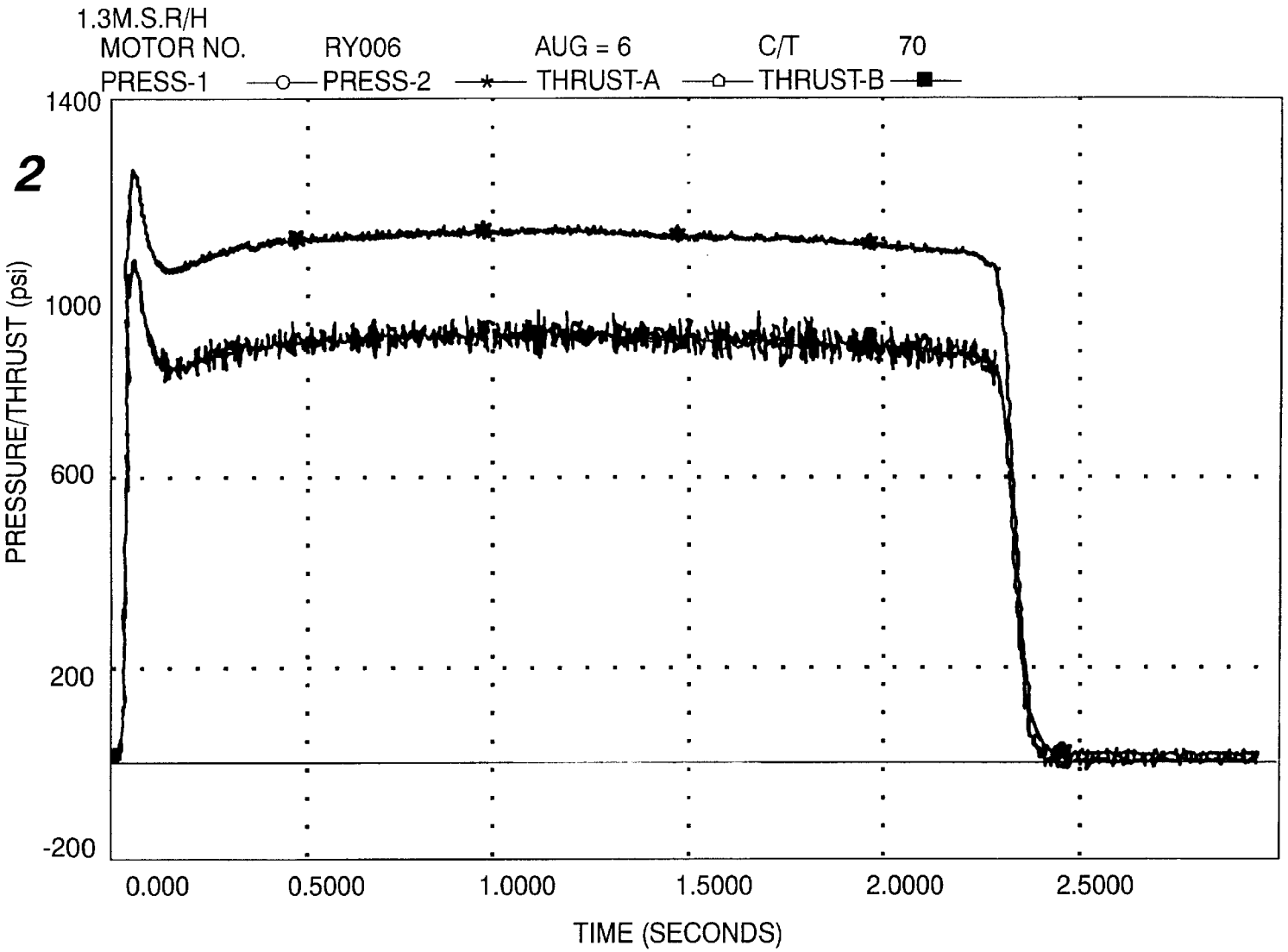
FIG. 2 is a graph plotting the pressure/thrust of the propellant composition of the present invention during a motor firing test.

FIG. 2 is provided to show a pressure and thrust history for a 6C4-11.4 motor firing with a non-eroding ATJ graphite throat.

Table 3 also provides more specific propellant characteristics for the above-noted formulation. Each of these tests clearly demonstrates that the propellant composition of the present invention exhibits exceptional propellant characteristics.

TABLE 3

| Firing Number | 1 | 2 | 3 |
|---|---|---|---|
| Temperature (°F.) | −25 | +70 | +145 |
| Total Impulse ($lb_f$-sec) | 2108 | 2162 | 2227 |
| Burn Time (sec) | 2.63 | 2.18 | 1.73 |
| Action Time (sec) | 4.11 | 3.67 | 2.92 |
| Ave. Burn Pressure (psia) | 1154 | 1404 | 1785 |
| Ave. Burn Thrust (psia) | 666 | 813 | 1044 |
| Maximum Pressure (psia) | 1225 | 1503 | 1856 |
| Maximum Thrust ($lb_f$) | 706 | 863 | 1084 |
| Propellant Mass ($lb_m$) | 11.85 | 11.83 | 11.84 |

The following examples are given to illustrate various embodiments of the present invention. These examples are given by way of example only, and it is to be understood that the following examples are not comprehensive or exhaustive of the many types of embodiments of the present invention that can be prepared in accordance with the present invention.

EXAMPLES

Examples 1–3

The following batches were prepared the same way as the formulation noted above and represent Class 1.3 propellants.

TABLE 4

| Batch | Example 1 | Example 2 | Example 3 |
|---|---|---|---|
| BTTN/DEGDN/MNA, % | 63.9 | 71.8 | 68.6 |
| LNC, % | 0 | 11.0 | 10.5 |
| PNC, % | 33.0 | 12.75 | 12.75 |
| LC-12-15 Paste, % | 2.2 | 1.8 | — |
| $Bi(subsal)_2$ paste, % | — | — | 6.0 |
| Al/C, % | 0.9 | 0.9 | 0.6 |
| N-3200, % | 0 | 1.75 | 1.55 |
| EOMV,kP/°F. | 0.5/114 | 2.0/64 | 4.5 |
| $1_{sp}$, $lb_f$-sec/$lb_m$ | 243.6 | 243.2 | 237.4 |
| p,$lb_f/in^3$ | 0.0561 | 0.055 | 0.0556 |
| Card Gap | −69 | −70 | +56/−60 |
| $r_b$ at 1000 psi, in/sec | 0.47 | 0.56 | 0.41 |
| 2000 psi | 0.58 | 0.69 | 0.58 |
| n | 0.30 | — | 0.74 |
| 70° F. E/σ/ϵ, psi/psi/% | 152/543/170 | 94/36/31.6 | 224/39/46.4 |
| 140° F, E, psi/−40° F. ϵ, % | 62(145)/26(−45) | 117/41 | 124(150)/29(−50) |

The energetic oxidizer/plasticizer noted above as BTTN/DEGDN/MNA is a standard mixture that includes 62.2% by weight BTTN, 22% by weight DEGDN, 13.3% by weight NC, 1.9% by weight MNA and 0.5% by weight 2NDPA (nitrodiphenylamine), which are both thermal stabilizers.

The results set forth above for the propellant compositions of the present invention provided in Examples 1–3 indicate that the burning rates of the propellant are effectively modified by the addition of a ballistic modifier pasted in an inert polymer. The burn rate versus pressure is well within the range required for a usable propellant formulation. In addition, these data indicate that acceptable propellants are formed with ballistic modifier/polymer in the range of 1% to 6% by weight of the total propellant composition. More preferably, the amount of pasted ballistic modifier is within the range of 2–4% by weight, where 2.2 is the optimum amount of burn rate modifier.

It should be noted that the percentage burn rate modifier relates to the ballistic modifier plus the inert polymer. Consequently, the actual percentage of the specific ballistic modifier itself is actually almost half of the total amount of burn rate modifier present in the propellant composition, since the pasted burn rate modifier includes only approximately 40–70% ballistic modifier. In summary, the present invention provides methods and compositions for controlling the burn rate of solid rocket motor propellants with less ballistic modifier required to accomplish the same overall control features of prior propellant compositions. Such a reduction permits the continued use of lead based ballistic modifiers without increasing many of the negative by-products of such ballistic modifiers when larger amounts were required.

Additional formulations are provided below in Table 5 that exhibit similar characteristics to those provided above.

TABLE 5

| Batch | Example 4 |
|---|---|
| LNC/BTTN/DEGDN/MNA, % | 79 |
| PNC, % | 14.0 |
| LC-12-15 Paste, % | 3.0 |
| Al/C, % | 1.0/0.4 |
| N-3200, % | 2.6 |

The above formulation was prepared by first mixing 34 wt % BTTN/DEGDN/MNA, with 3.0 wt % LC-12-15, 14 wt % PNC, and 0.4 wt % C. This mixture is sheered until smooth.

Then, 45 wt % BTTN/DEGDN/MNA is added, followed by the addition of the aluminum flake and curing agent in the amounts noted above.

A comparison was also conducted to compare the burning rate versus pressure of a propellant including the pasted ballistic modifier of the present invention and a propellant not including the pasted ballistic modifier of the present invention. Specifically, the propellant (B11326) including the pasted ballistic modifier included 50.8% BTTN. 18.0% DEGDN, 23.6% NC, 2.0% MNA, 2.2% LC- 12–15 (pasted), 0.4% C, 1.0% flake aluminum, 2.0% N-3200 (curative). The propellant (B 11323) that does not include the pasted ballistic modifier included 52.9% BTTN, 18.6% DEGDN, 24.0% NC, 2.0% MNA, and 2.5% N-3200 (curative). The above percentages are weight percentages of the total weight of the propellant composition.

Figure 3:
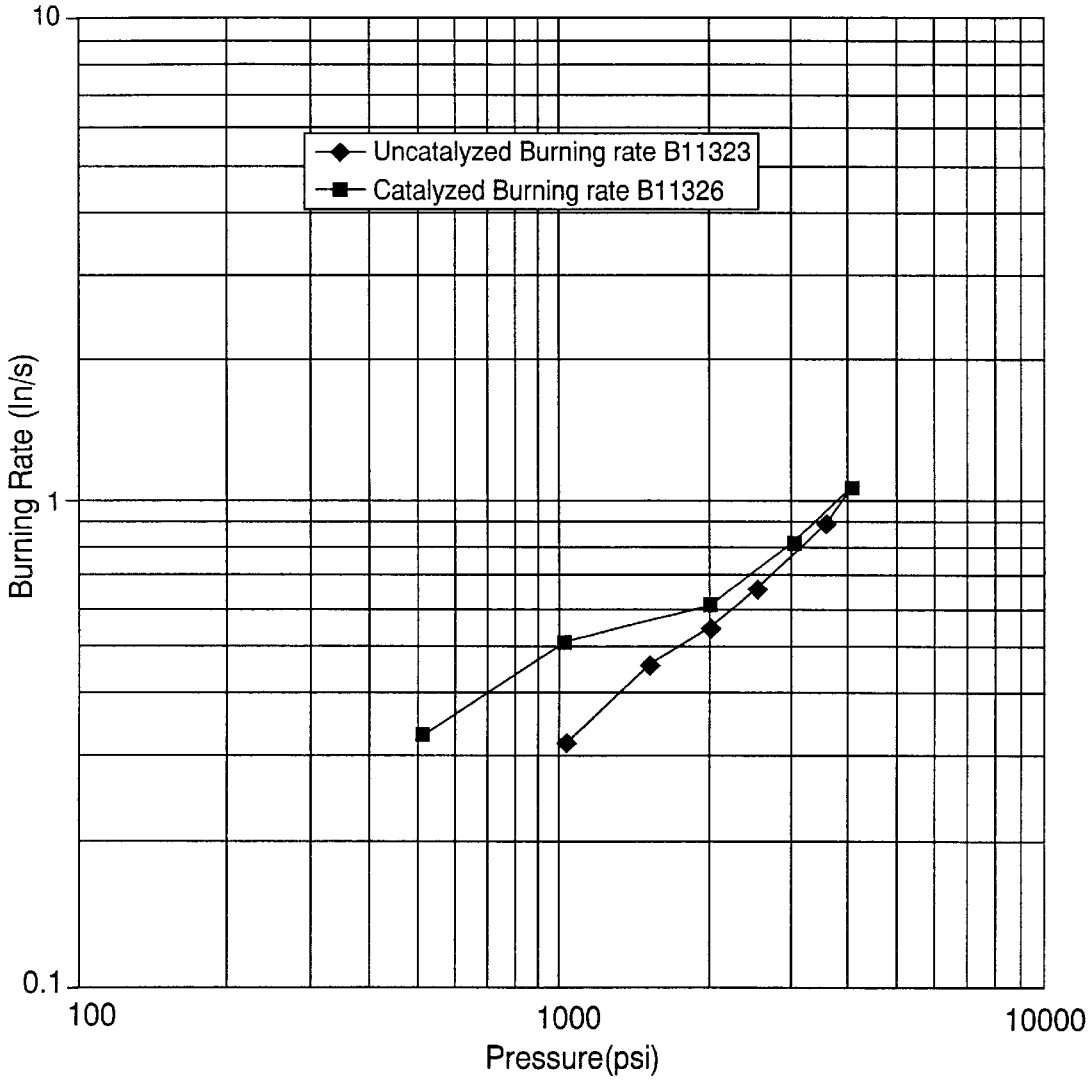
FIG. 3 is a graph plotting the static burning rate of the composition of the present invention compared with that of a propellant not including a pasted ballistic modifier.

The bum rate was determined at various pressures and plotted logarithmically, as provided in FIG. 3. As can be seen from this plot, the propellant lacking the pasted ballistic modifier exhibits a pressure exponent greater than 1.0, while the propellant of the present invention exhibits a pressure exponent less than 0.7 from 1000–2500 psi.

By formulating the propellants as taught by the present invention it is possible to avoid some of the significant problems encountered with conventional burn rate modifiers. In particular, the present invention provides compositions and methods for modifying a burn rate while minimizing the use of lead, copper, or similar materials. Pasting the ballistic modifier in an inert polymer allows better dispersion of the ballistic modifier in the propellant, therefore requiring reduced amounts of the ballistic modifier, which minimizes the toxicity associated with the use of metals.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A propellant consisting essentially of:

from about 8% to about 15% by weight of a nitrocellulose binder;

from about 60% to about 80% by weight of one or more nitrate ester energetic plasticizers;

from about 1% to 6% by weight of a burn rate modifier, wherein said burn rate modifier includes a ballistic modifier selected from the group consisting of bismuth, tin and copper compounds and organometallic complexes pasted in an inert polymer, and wherein the burn rate modifier comprises 40–70% by weight of said inert polymer;

from about 1.5% to 2.5% by weight of a thermal stabilizer;

from about 5% to 20% by weight of plastisol nitrocellulose;

from about 0.5% to 1.5% by weight of a combustion stabilizer; and from about 0.5% to 2.5% by weight of a curing agent.

2.The propellant of claim 1, wherein said bum rate modifier comprises 50–65% by weight of said solid ballistic modifier.

3. The propellant of claim 1 wherein the inert polymer is a liquid polymer compatible with nitrate esters.

4. The propellant of claim 3 wherein said inert polymer is selected from the group consisting of polyethylene glycol, polyethylene glycol adipate and polycaprolactone.

5. The propellant of claim 1 wherein said ballistic modifier is a lead-copper complex of β-resorcylic acid and salicylic acid.

6. The propellant of claim 1 wherein said burn rate modifier further comprises carbon.

7. The propellant of claim 6 wherein said burn rate modifier comprises 10–30% by weight of said carbon.

8. A propellant consisting essentially of:

from about 8–15% by weight of a lacquer-grade nitrocellulose binder;

from about 60–80% by weight 1,2,4-butanetriol trinitrate/diethylene glycol dinitrate;

from about 1.5–2.5% by weight n-methylnitroanaline;

from about 5–20% by weight of plastisol nitrocellulose;

from about 0.2–0.5% by weight carbon;

from about 2–5% by weight of a burn rate modifier, wherein said burn rate modifier includes a ballistic modifier selected from the group consisting of bismuth, tin and copper compounds and organometallic complexes pasted in an inert polymer, and wherein the burn rate modifier comprises 40–70% by weight of said inert polymer;

from about 0.2–1.0% by weight flake aluminum;

from about 0.5–1.5% by weight of a curing agent; and from about 0.5–1.55 by weight 2-nitrodiphenylamine.

9. The propellant of claim 8, wherein said burn rate modifier comprises 10–30% by weight of said carbon.

* * * * *